United States Patent [19]

Williams et al.

[11] 3,935,995

[45] Feb. 3, 1976

[54] SWINGING BUCKET CENTRIFUGE ROTOR

[75] Inventors: John Francis Williams, New Canaan; Mark William Hayden, Bridgeport, both of Conn.

[73] Assignee: E. I. Du Pont de Nemours and Company, Wilmington, Del.

[22] Filed: May 7, 1975

[21] Appl. No.: 575,404

[52] U.S. Cl. ..... 233/26

[51] Int. Cl.[2] ..... B04B 9/12

[58] Field of Search ..... 233/1 R, 11, 26, 27

[56] References Cited

UNITED STATES PATENTS

| | | | |
|---|---|---|---|
| 3,393,864 | 7/1968 | Galasso et al. | 233/26 |
| 3,743,174 | 7/1973 | Drucker | 233/26 |
| 3,752,390 | 8/1973 | Chulay | 233/26 |

FOREIGN PATENTS OR APPLICATIONS

| | | | |
|---|---|---|---|
| 731,330 | 6/1955 | United Kingdom | 233/26 |

*Primary Examiner*—George H. Krizmanich

[57] ABSTRACT

A swinging bucket centrifuge rotor has a plurality of peripheral cavities each adapted to seat a swinging bucket. Each cavity has a hanger which is slideably positioned in a receptacle in the rear of the cavity. The receptacle prevents rotation of the hanger about its path of movement. The extremity of the hanger forms a hook which is adapted to support a cross-pin located in the swinging bucket cap. The cross-pin is so positioned that the bucket must hang properly from the hook. In like manner the hook has an outwardly and downwardly sloping entrance opening which further aids in properly hanging a bucket.

9 Claims, 3 Drawing Figures

SWINGING BUCKET CENTRIFUGE ROTOR

BACKGROUND OF THE INVENTION

This invention relates to centrifuges and more particularly to swinging bucket type centrifuges.

Swinging bucket centrifuges typically include a rotor having a pluralilty of peripheral cavities therein. Each cavity houses a swinging member, usually referred to as a bucket, which holds the material to be centrifuged. The buckets are pivotally mounted in each cavity, such that they normally hang with a vertical orientation. As the rotor increases speed, the buckets, because of centrifugal force, swing outwardly and desirably assume a horizontal position. The pivotal mounting is provided with some means of flexure by which the buckets, under the influence of extreme centrifugal force at the higher speeds of rotation, are permitted to move radially outward until they are supported by or seated within the rotor cavity itself such that they are restrained from further outward movement. The reverse sequence occurs as the rotor is slowed down, i.e., the buckets are retracted radially inward such that they unseat from the rotor cavity and are allowed to swing back down to a vertical orientation.

Among the early designs of these type of rotors, flexure was provided by elongated pins which extended through a section of the rotor. Unfortunately these pins required a relatively large amount of rotor space and severely limited the number of cavities and, hence, the number of buckets that could be positioned within one rotor.

An improvement over this design which permitted the use of more swinging buckets in a given rotor was provided by Galasso et al. in U. S. Pat. No. 3,393,864, issued July 23, 1968. Galasso et al. taught that each of the buckets is supported by an independent bucket hanger assembly disposed with a cavity in the rotor. Each hanger assembly is spring biased in a radial direction towards the axis of rotation of the rotor and includes a separate pin member carried by the assembly from which a bucket can be suspended. While the Galasso et al. apparatus provided a vast improvement over the pin mountings, it unfortunately has many disadvantages. Among these disadvantages is that the hanger mounting screws can and do become loosened with use and vibration. In this event, the required precise positioning of that bucket is lost. The bucket hanger can then rotate which may cause the bucket to drop off or not seat properly. Either can result in an unbalanced rotor and cause possible rotor spin-off at high speed. The resulting damage can be very expensive.

Another swinging bucket rotor is described by Chulay, in U.S. Pat. No. 3,752,390, issued Aug. 14, 1973. In Chulay, the rotor cavities each have a vertically positioned torsion bar extending downwardly through the rotor into the bucket cavity. A disadvantage of the Chulay assembly, as well as the Galasso et al. assembly, is that the bucket, which must be precisely mounted, can easily be mounted backwards by the careless user. This can result in rotor imbalance. Further the buckets can be improperly mounted such that they are not securely engaged by the hook support provided. In this case, the buckets may fly off as soon as the rotor begins operation.

Accordingly, it is an object of this invention to obviate many of the difficulties encountered in the prior art swinging bucket type centrifuges.

A further object of this invention is to provide a centrifuge rotor which has an improved bucket hanger assembly.

An additional object of this invention is to provide an improved swinging bucket centrifuge which facilitates the proper positioning of the buckets.

BRIEF DESCRIPTION OF THE INVENTION

According to a preferred embodiment of the invention, a swinging bucket centrifuge is constructed in which the rotor defines a plurality of peripheral cavities therein and is adapted to turn about its axis. Each of the cavities is configured to seat a swinging bucket in the outer or peripheral portions of the rotor cavity. Hanger means are provided in each cavity for pivotally supporting a bucket nominally in a vertical position and yet permitting the bucket to swing, under the influence of centrifugal force, to a horizontal position during operation. Each hanger means is capable of radial movement during centrifuging to facilitate seating the bucket within its cavity. A receptacle is provided radially contiguous to each cavity to slideably receive, along a radius of the rotor, at least a portion of the hanger means. Means are provided for preventing the rotation of the hanger about its path of movement.

In a particularly preferred embodiment each bucket has a cap which includes a tab on which is mounted a cross-pin adapted to pivotally engage an associated hanger means. Each hanger means includes a pair of spaced hooks defining a vertically disposed, U-shaped opening adapted to straddle the tab and engage the cross-pin. The entrance of opening of the hooks is sloped downwardly such that the pin must fully engage a hook or it will slip off during the mounting procedure. This prevents improper mounting. Further the pin is mounted off-center relative to the tab such that the bucket may engage the hook in only one sense, the proper sense. Rotor imbalance is thereby averted.

BRIEF DESCRIPTION OF THE DRAWINGS

The novel features of this invention as well as the invention itself, both as to its organization and method of operation, will best be understood from the following description, when read in connection with the accompanying drawing, in which like reference numerals refer to like parts, and in which.

DETAILED DESCRIPTION OF THE PREFERRED EMBODIMENTS

Figure 1:
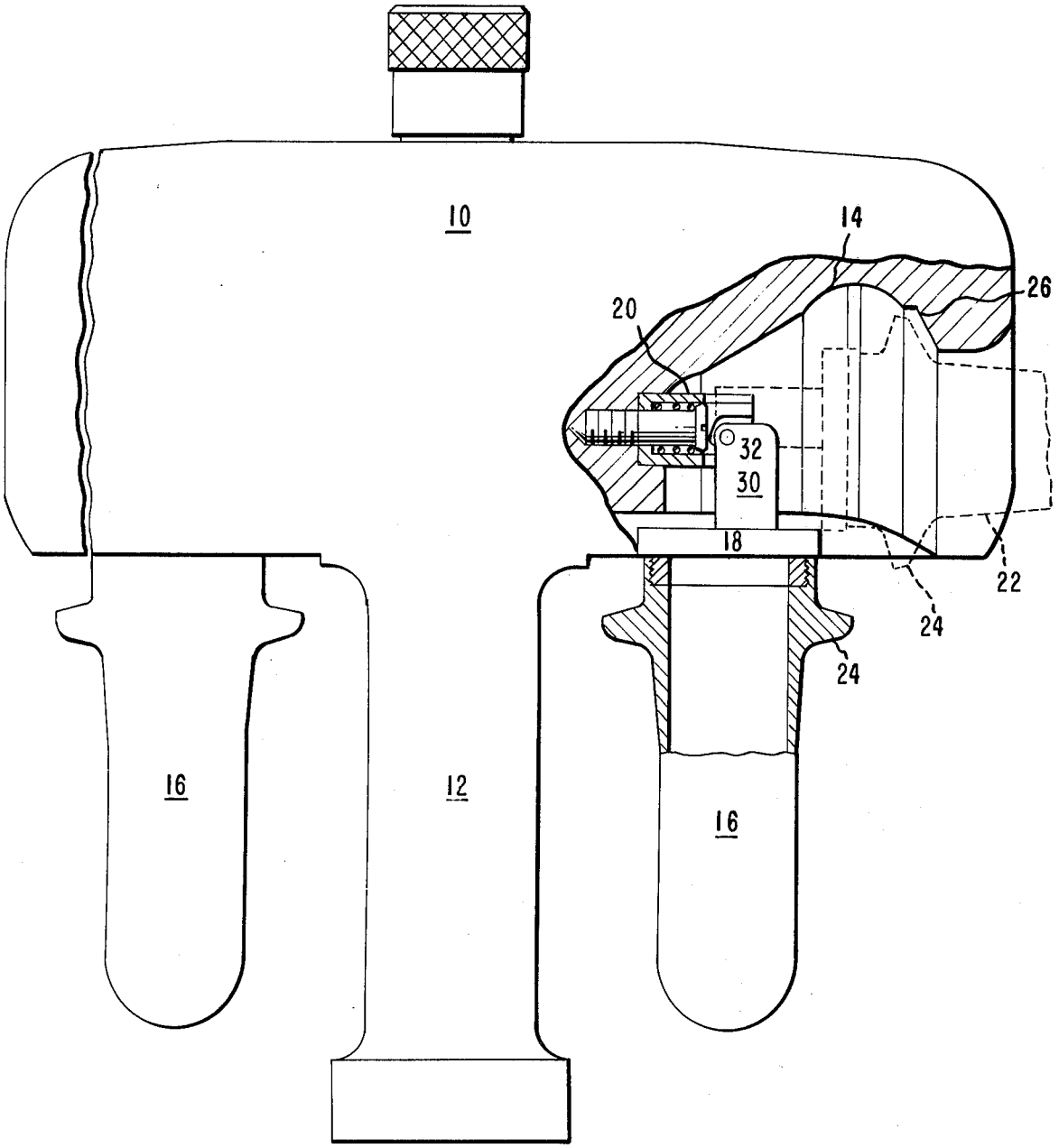
FIG. 1 is an elevation view, partially cut away, of the rotor assembly of a swinging bucket type centrifuge depicting the manner of mounting the swinging buckets in accordance to this invention and showing a bucket in both vertical and horizontal orientation.

There is seen in FIG. 1 an otherwise conventional centrifuge rotor 10. The rotor 10 is mounted on a drive shaft 12 which is driven by a suitable means, i.e., an electric motor, appropriate gears, base, and the like. Disposed about the peripheral portions of the rotor 10 are cavities 14 only one of which is shown. There is positioned within each cavity a swinging member, usually referred to as a bucket 16, each of which has a plug or cap 18. Each bucket has a flanged collar or shoulder 24 which is adapted to seat within a seat 26 on the inner side of the peripheral portion of the cavity in which it is housed. The buckets containing the material or fluid which is to be centrifuged are usually constructed of a suitable lightweight metal, such as aluminum or titanium, capable of withstanding the large centrifugal forces that the bucket undergoes during the operation. They are pivotally hung from a hanger assembly 20 constructed in accordance to this invention, as will be described.

The swinging buckets 16 are depicted in FIG. 1 as hanging downwardly in a vertical position which is their orientation when the rotor is at rest. When the rotor is in operation and spinning, the buckets swing outwardly to a horizontal position or orientation depicted by the dashed line 22 in FIG. 1. As the rotor spin speed increases, the centrifugal force is such that the buckets extend radially outwardly until their flanged collar or shoulder 24 engages the recess or shoulder seat 26 formed in the outer portion of the cavity 14. Thus when the bucket is horizontally oriented and subjected to extreme centrifugal forces, it seats within the shoulder seat 26, as is depicted particularly in FIG. 3.

Figure 3:
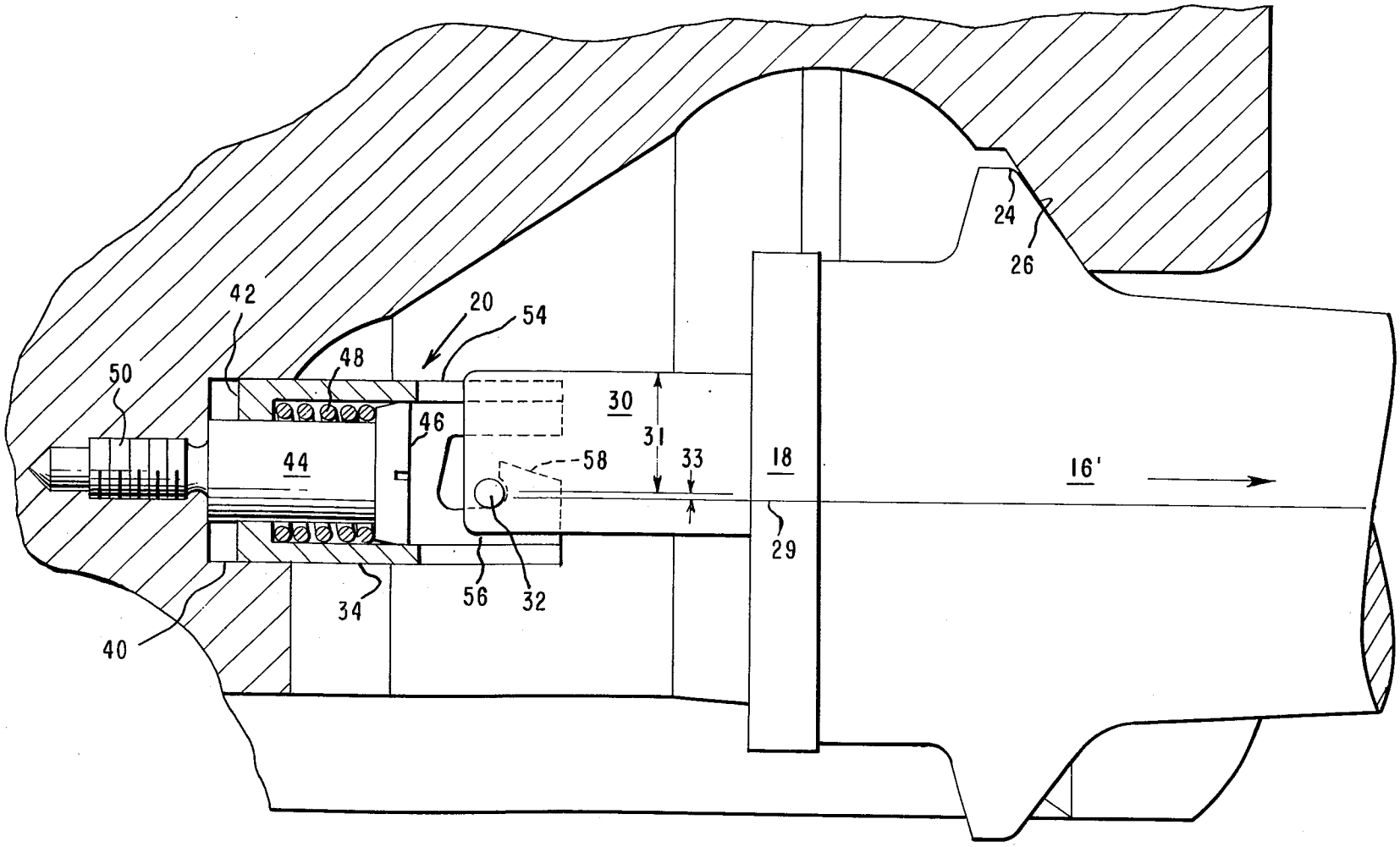
FIG. 3 is a fragmentary section view of the rotor cavity illustrated in FIG. 1 depicting the rotor seated within the cavity under the influence of centrifugal force.

In accordance with this invention, the bucket cap 18 includes an elongated tab 30, typically having a rectangular cross-section extending axially upwardly therefrom (FIG. 1). The tab is acentrically of the central axis 29 (FIG. 3) of the bucket 16 and the upper portion therefrom has a cross-pin 32 secured therein as by a friction fit. The reason for this acentricity will be described hereinafter. The cross-pin is located somewhat off of the central axis of the bucket in the direction of the tab's acentricity. This locates the cross-pin slightly above the central axis 29 of the bucket when the bucket is in a horizontal position as depicted in FIG. 3. The reason for this slight acentricity is to enable the bucket to assume, as nearly as possible, a horizontal position. Without this acentricity, i.e., if the cross-pin were located precisely on the central axis 29 of the bucket, the bucket theoretically, because of gravity, could never assume an absolutely horizontal position. By way of example, this acentricity or offset distance 33 typically is selected to be about 20 mils for a bucket capable of holding 38.5 ml. of fluid and to be used in a rotor spinning at 27,000 rpm. Although preferred, this offset for the pin need not be used if desired and the cross-pin may be located on the bucket axis. Other offsets may be used according to the weight of the bucket and the angular spin rate of the rotor.

Figure 2:
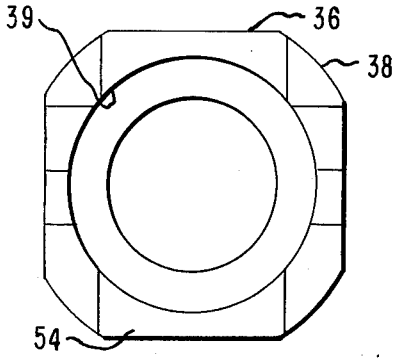
FIG. 2 is an end elevation view of the hanger illustrated in FIG. 1.

The hanger assembly 20 includes a hanger 34. The hanger 34 may be described as elongated and generally tubular having planar exterior surfaces 36, as is seen most clearly in FIG. 2, such that it has a generally square or rectangular exterior configuration when viewed from the end with rounded corners 38 and a cylindrical interior 39. The hanger 34 is adapted to have a sliding fit within a receptable 40 formed in the rotor itself such that the hanger is capable of a sliding movement along its axis and/or a radius of the rotor. The receptacle 40 also has a square or rectangular cross-section to prevent the hanger from rotating about its path of movement. The rear portion 42 of the hanger is of a reduced diameter to provide a sliding fit about a shoulder screw 44. The screw has an enlarged head 46 that fits within the hanger. A compression spring 48 fits over the screw and is compressed between the head 46 of the screw and the reduced diameter portion 42 of the hanger 34. The screw 44 is threaded into a bore 50 in the rotor itself. In this manner the hanger 34 is capable of sliding axial movement radially outward of the rotor and is normally biased by the spring 48 inward towards the axis of rotation of the rotor.

The outer peripheral portion of the hanger 34 is split or forked so as to have a vertically opening, slotted portion 54 capable of accommodating the tab 30 of the swinging bucket. The slotted portion 54 of the hanger 34 is defined by a pair of spaced hooks 56 adapted to engage the cross-pin 32. The hoods both have a horizontal opening defined by a sloping surface 58 which, when the hanger is mounted in the horizontal position illustrated, slopes downwardly and outwardly. In this manner, if cross-pin 32 inadvertently is placed on the sloping portion during the time that the bucket is being mounted, it would slide off and not be permitted to remain in an unstable, improperly mounted position only to fly off when the rotor goes into operation as was possible with prior art rotors.

The tab 30 is mounted acentrically such that the greater distance from the cross-pin to the side of the tab, i.e., in the direction of acentricity is the offset distance 31. This offset distance 31, relative to the side of the tab 30, is greater than the axial depth of the open portion 54. The cross-pin thus cannot be mounted with the hook except in the one, correct position illustrated. Improper or backward mounting of the bucket assembly is virtually impossible.

In operation, as the rotor begins to spin, the normally vertically oriented buckets 16 (FIG. 1) gradually swing outwardly until they assume the position depicted by the dashed lines 22 (FIG. 1). As the speed continues to increase, the centrifugal force, acting against the bias of the spring 48, causes the hanger 34 to withdraw axially along a radius of the rotor until the bucket flange 24 seats on the seat 26 of the rotor such that the bucket is properly seated.

This hanger 34 has the advantage that, because of its generally rectangular cross-section, it cannot rotate within the receptacle 40. Hence if the screw 44 loosens slightly during operation of the rotor, it cannot twist and thereby cause possible destruction of the rotor because the bucket becomes misaligned and causes rotor imbalance.

The swinging buckets may be mounted only in the proper position. Because of the width of the tab 30 with the cross-pin 32 acentrically mounted as described, the bucket may be mounted with the spaced hooks 56 only in the proper manner as illustrated. Furthermore, if the cross-pin is not introduced far enough into the hanger to properly engage the hooks, it will light upon the downwardly sloping surface 58 of the hanger 34 and immediately slide off. The operator thus has the opportunity to rehang the bucket. Because the cross-pin 32 is acentrically mounted, the bucket can only be hung with the cross-pin slightly above the axis 29 of the bucket when the bucket is horizontally oriented. Hence the bucket is able to assume the desired horizontal orientation.

It is thus apparent that the apparatus described offers a number of unique advantages not found in the prior art of swinging bucket rotors.

We claim:

1. In a swinging bucket centrifuge having a rotor which defines a plurality of peripheral cavities therein and is adapted to turn about its axis and hanger means in each said cavity for pivotally supporting a bucket nominally in a vertical orientation and yet permitting said bucket to swing under the influence of a centrifugal force to a horizontal orientation during operation, each said hanger means being capable of movement radially of said axis during operation to facilitate seating its said bucket in its said cavity, the improvement comprising:

a receptacle defined by said rotor radially contiguous each said cavity adapted to slideably receive along a radius of said rotor at least a portion of said hanger means, and means in each said receptacle for preventing the rotation of a hanger means about its path of movement.

2. A centrifuge according to claim 1 wherein each said bucket has a cap which includes a tab extending axially of said bucket, and a cross-pin secured in said tab adapted to pivotally engage an associated said hanger means.

3. A centrifuge according to claim 2 wherein each said hanger means includes a hook for pivotally engaging an associated said cross-pin.

4. A centrifuge according to claim 2 wherein each said hanger means forms a pair of spaced hooks defining a U-shaped, vertical opening adapted to straddle said tab and pivotally engage said cross-pin.

5. A centrifuge according to claim 4 wherein said tab is positioned acentrically of said cap such that the greater distance from said cross-pin to the side of said tab exceeds the depth of said U-shaped opening, whereby said bucket can only be positioned on said hanger in a first sense.

6. A centrifuge according to claim 5 wherein said cross-pin is positioned acentrically of the axis of said bucket in the direction of said tab acentricity, thereby to facilitate said bucket assuming a horizontal orientation during operation.

7. A centrifuge according to claim 6 wherein said hooks define a horizontal entry opening for said cross-pin having lower surfaces that slope downwardly and outwardly from said opening, thereby to prevent improper positioning of said pin.

8. A centrifuge according to claim 2 wherein said hanger includes a hook which defines a horizontal entry opening for said cross-pin having lower surfaces that slope downwardly and outwardly from said opening, thereby to prevent improper positioning of said pin.

9. A centrifuge according to claim 8 wherein said means for preventing rotation of said hanger means includes mating planar surfaces in said receptacles and on said hanger means.

* * * * *